United States Patent [19]

Suzuki et al.

[11] Patent Number: 4,980,958

[45] Date of Patent: Jan. 1, 1991

[54] ELECTRICAL CABLE-MAKING APPARATUS

[75] Inventors: Satoshi Suzuki; Minoru Abe, both of Kawasaki, Japan

[73] Assignee: AMP Incorporated, Harrisburg, Pa.

[21] Appl. No.: 363,562

[22] Filed: Jun. 7, 1989

[30] Foreign Application Priority Data

Nov. 20, 1987 [JP] Japan ..... 62-293859

[51] Int. Cl.[5] ..... H01R 43/00

[52] U.S. Cl. ..... 29/33 M; 29/564.6; 29/564.8; 29/566.3

[58] Field of Search ..... 29/33 M, 564.1, 564.2, 29/564.6, 564.7, 564.8, 566.3, 747, 749, 753, 854, 857; 156/177

[56] References Cited

U.S. PATENT DOCUMENTS

| | | | |
|---|---|---|---|
| 4,114,014 | 9/1978 | Shogo et al. | 29/564.6 |
| 4,372,041 | 2/1983 | Winkelman | 29/747 |
| 4,380,117 | 4/1983 | Brandewie et al. | 29/747 |
| 4,388,142 | 6/1983 | Hembert | 29/755 |
| 4,404,743 | 9/1983 | Brandewie et al. | 29/749 X |
| 4,551,893 | 11/1985 | Ikeda et al. | 29/33 M |
| 4,588,462 | 5/1986 | Horowitz et al. | 156/177 |
| 4,835,858 | 6/1989 | Adlon et al. | 29/857 |

FOREIGN PATENT DOCUMENTS

| | | |
|---|---|---|
| 0130743 | 1/1985 | European Pat. Off. . |
| 2021987 | 12/1979 | United Kingdom . |

*Primary Examiner*—William Briggs
*Attorney, Agent, or Firm*—Adrian J. LaRue

[57] ABSTRACT

An electrical cable-making apparatus includes a cable-making area in which a shuttle mechanism (10) moves electrical wires (1) clamped therein from a first position to a second position at which the spaced wire ends are positioned between spaced parallel tapes (26). Clamping members (25c) move the tapes into engagement with the spaced wire ends and clamp the taped wire ends therebetween whereafter the shuttle mechanism (10) having been unclamped from the wire moves along the wires back to the first position. A wire-feeding mechanism (34, 38) feeds the wires (1) to a prescribed length and cutting and terminating members (**61, 61*a*) cut the wires and terminate them in an electrical connector (2) thereby forming a cable with one end of the wires being taped and the other ends connected to a connector. A transfer mechanism (40) receives the wires (1**) adjacent the taped wire ends and transfers the cable away from the cable-making area.

8 Claims, 6 Drawing Sheets

ELECTRICAL CABLE-MAKING APPARATUS

FIELD OF THE INVENTION

This invention relates to electrical cable-making apparatus and more particularly to a cable-making apparatus for applying tape to spaced ends of a plurality of electrical wires, driving the wires to a specified length, terminating the other ends of the wires in an electrical connector while severing the wires and conveying the cable assembly to a discharge station.

BACKGROUND OF THE INVENTION

Electrical cables, which have one end of its electrical wires electrically connected to a single electrical connector, are used for many purposes. Various cable-making apparatuses are available for automatically making electrical cables. Japanese Patent Publication No. 60-30009 discloses one of these cable-making apparatuses wherein front ends of electrical wires are clamped in a movable shuttle which is moved to a first position at which the wire front ends are electrically connected to a first electrical connector. The shuttle is unclamped from the wires and returned to its original position whereafter the wires are fed to a prescribed length, electrically connected to a second electrical connector and cut from the wire supply thereby forming an electrical cable. The cable is then transferred away from the cable-making area at a right angle thereto so as not to obstruct the cable-making area.

FIG. 6A shows electrical wires 100*a* and 101*a* which have one of their ends electrically connected to respective electrical connectors 100, 101 while the other ends are electrically connected to electrical connector 102. In this case, connecting wires 100*a*, 101*a* respectively to connectors 100, 101 and connecting wires 100*a*, 101*a* to connector 102 requires two operations which cannot be done by a single cable-making apparatus at the same time. Thus, while a first cable-making apparatus is being used to connect electrical wires 100*a*′ and 100*a*″ to connector 100′, as shown in FIG. 6B, tape 103 is applied to the unconnected ends of the wires so that the wires are properly spaced for a subsequent operation. FIG. 6B also shows that wires 100*a*′ and 100*a*″ can be of different lengths.

A cable with one of the ends of the electrical wires connected to a connector while the other ends are taped could not be transferred away from the cable-making area of the apparatus whereas a cable with both ends of the wires connected to connectors could be transferred away from the cable-making area of the apparatus.

In the case of the cable having one of the ends of the wires connected to a connector with the other ends being taped, an operator would have to apply tape to the other wire ends and remove the cable from the cable-making area because the taped wire ends could not be moved away from the cable-making area by the transfer mechanism due to the wires being flexible. This meant that time was required to apply the tape to the wire ends and remove the cable from the cable-making area before the next cable is made. The rate of making cables was poor and the operator was subjected to possible injury because the taping and removing operations had to be completed before the shuttle would start making the next cable. In addition, one or more of the wires would come loose from the tape.

As a result of the low production rate of the cable-making apparatus, the finished cables were placed in a special container where they would become entangled. Separating the cables proved to be troublesome and time consuming and wires would become free of the tapes.

It therefore became necessary to provide a cable-making apparatus to overcome the foregoing problems which could operate at a faster rate, automatically tape the unconnected or leading ends of the electrical wires after they have been arranged in spaced relationship, cut and connect the trailing ends of the wires after they had been fed to a prescribed length thereby forming a cable and transferring the cable from the cable-making area.

SUMMARY OF THE PRESENT INVENTION

A cable-making apparatus according to the present invention comprises a tape-positioning and applying mechanism that positions tapes in back of a wire-spacing member so that they are parallel to each other; a shuttle mechanism in which ends of electrical wires are located is moved to a first position from its original position in front of the wire-spacing member; a wire-clamping device of the shuttle mechanism, that has clamped the wires rearwardly of a header device, is moved against the header device thereby moving the wire ends through slots in the wire-spacing member so that the spaced wire ends are positioned between the spaced tapes; clamping and cutting members move the tapes into engagement with the wire ends while cutting the tapes and clamping the taped wire ends whereafter the shuttle mechanism, after the wire-clamping device releases the wires, is moved to its original position; a wire-feeding, cutting and terminating mechanism engages the wires feeding them from wire supply means to a prescribed length which then cuts the wires and terminates them to electrical contacts of an electrical connector thereby forming a cable; a pusher member pushes the wires along the slots of the wire-spacing member into coils of a coil spring on an endless chain which carries the cable after the taped wire ends have been released by the clamping and cutting members away from the cable-making area.

BRIEF DESCRIPTION OF THE DRAWINGS

The invention, together with the objects and advantages thereof, is best understood by way of example with reference to the following detailed description in conjunction with the accompanying drawings.

DETAILED DESCRIPTION OF THE INVENTION

Figure 1:
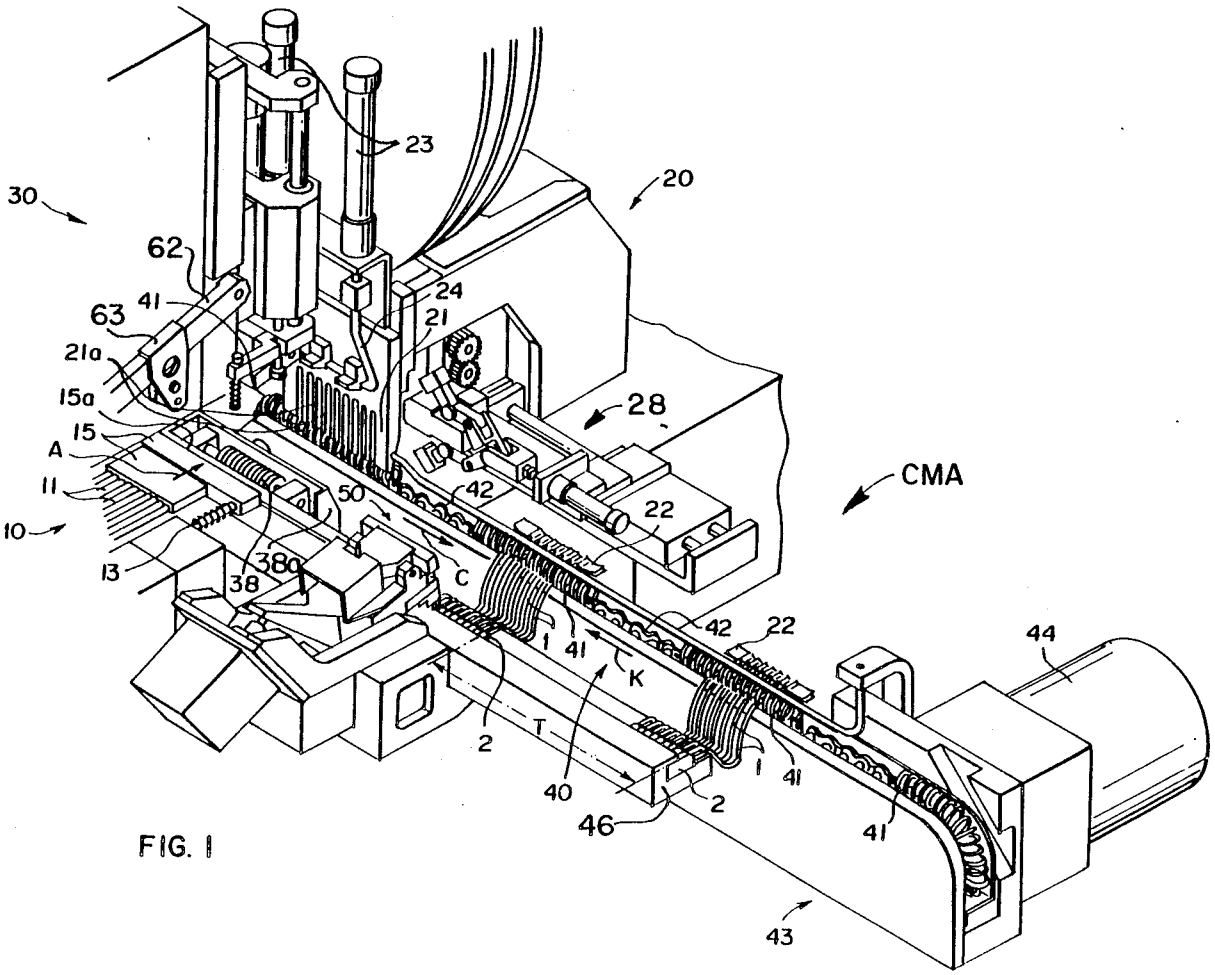
FIG. 1 is a perspective view of the electrical cable-making apparatus showing the principal parts thereof.

As shown in FIG. 1, electrical wires 1 from supply means (not shown) are arranged on a horizontal surface of a cable-making apparatus CMA and they extend through a wire-clamping device 14, tubes 11 and a header device 15 of a shuttle mechanism 10. Wire-clamping device 14 and a header device 15 are movable relative to one another via rods 13 around which are springs to maintain them normally separated from each other.

Figure 2:
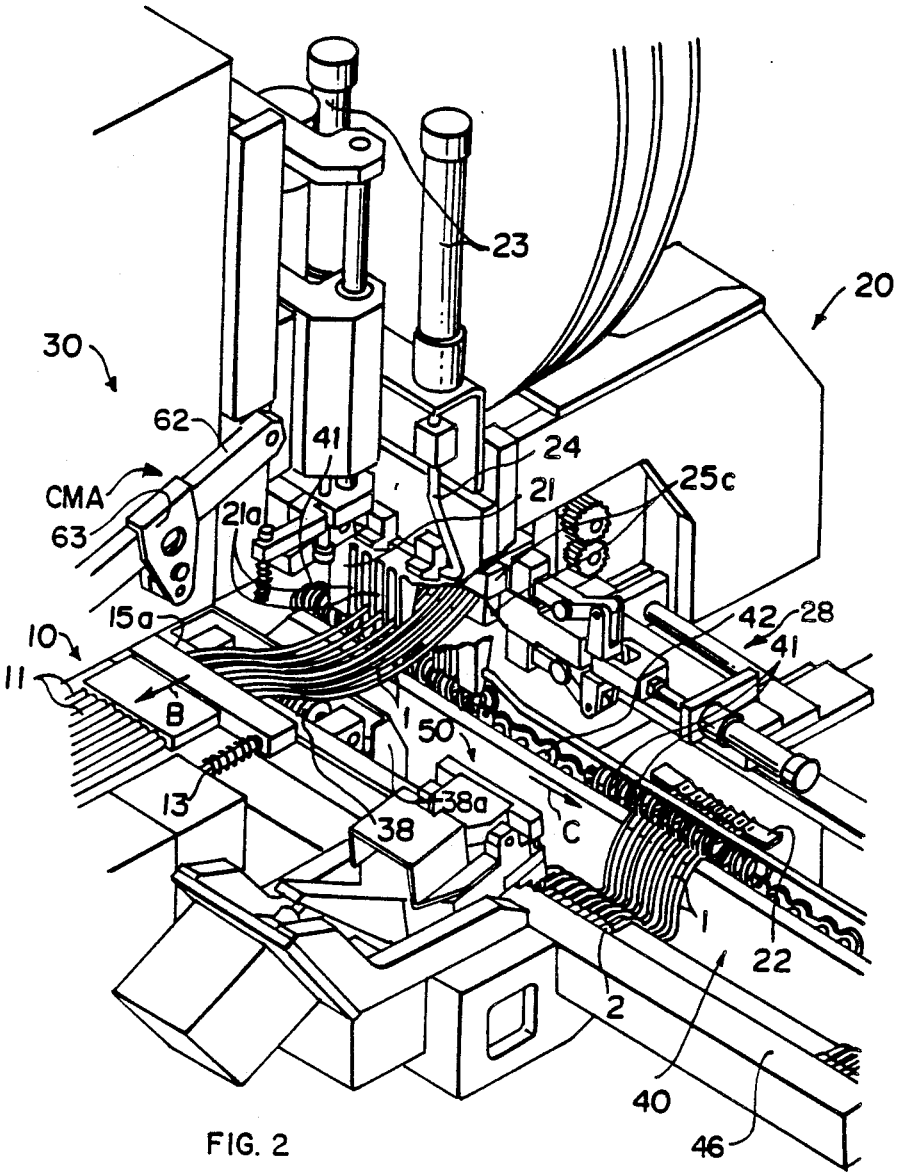
FIG. 2 is similar to FIG. 1 showing electrical wires extending across a cable-making area through slots in a wire-spacing member with ends of the wires clamped in clamping and cutting members.
Figure 4A:
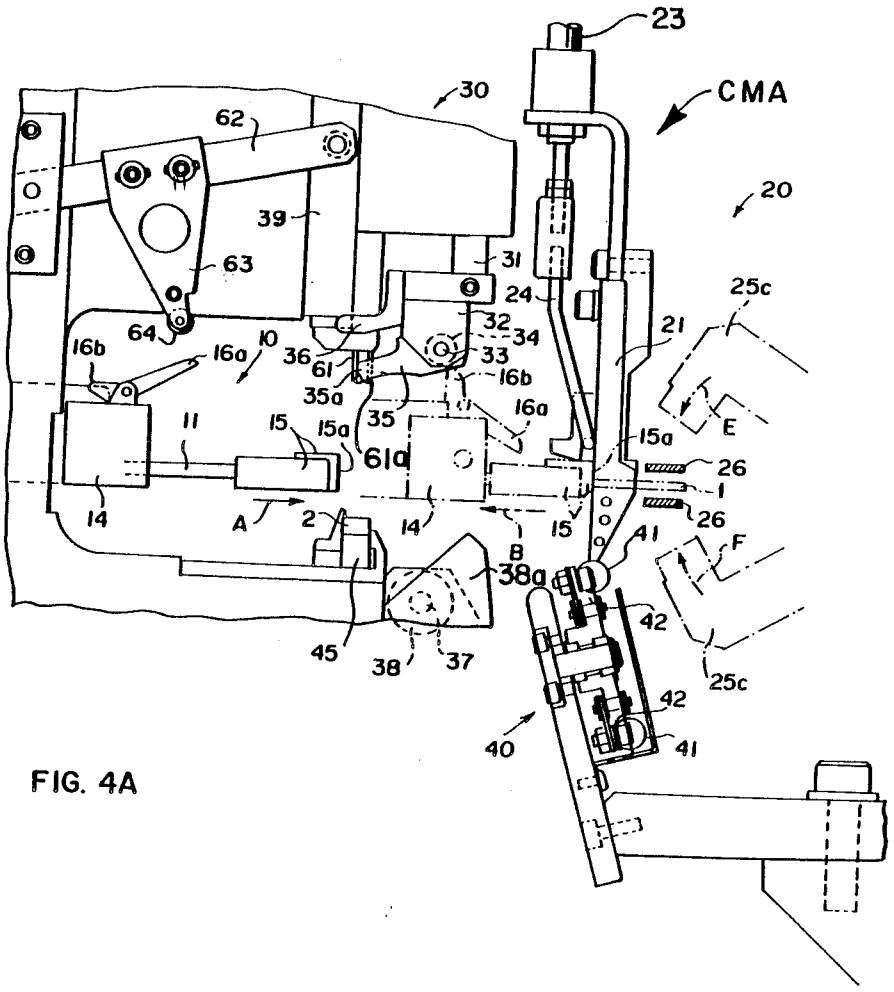
FIGS. 4A and 4B are part side elevational views of FIG. 1 illustrating the operation of the cable-making apparatus.

Electrical wires 1 clamped in shuttle mechanism 10, as explained hereafter, move with the shuttle mechanism 10 in the direction of arrow A, FIG. 1, until the front end 15*a* of header device 15 engages wire-spacing member 21. Wire-clamping device 14 moves toward header device 15 compressing the springs on rods 13 and moving the ends of wires 1 through slots 21*a* in wire-spacing member 21 until they are positioned between parallel tapes 26, as shown in FIG. 4A, which are placed there by tape-positioning and clamping mechanism 20, to be described hereafter. Tape-positioning and clamping mechanism 20 applies tapes 26 to the ends of wires 1 by clamp members 25*c* while clamping onto the taped wire ends and cutting tapes 26 from their supplies (not shown), as shown in FIG. 2, whereafter the shuttle mechanism 10 returns to its original position as shown by the arrow B. Slots 21*a* of wire-spacing member 21 maintain the ends of wires 1 in properly spaced relationship between tapes 26 prior to the tapes being applied thereon. Before the shuttle mechanism 10 returns to its original position, as shown in solid lines in FIGS. 4A, 4B, wire-clamping device 14 is operated to unclamp the wires, as described later, enabling the wire-feeding mechanism 30 to feed wires 1 to prescribed lengths and then cut and terminate the wires 1 in electrical connector 2 thereby completing the electrical cable, as shown in broken lines in FIG. 4B, which has one end of the wires taped while the other ends are connected to a connector 2. The taped wire ends are then positioned in coil springs 41 of a transfer mechanism 40 by a pusher member 24 which transfers the cable away from a cable-making area of the apparatus in the direction of arrow C, FIGS. 1, 2 and removed at a location 43 thereof. During the movement of the cable by transfer mechanism 40, connector 2 is subjected to inspection by inspection device 50 to inspect the condition of the terminations of wires 1 with the contacts of connector 2.

Coil springs 41 have the same spacing as that of slots 21*a* of wire-spacing member 21, and they enable the cables to be easily removed from the transfer mechanism 40 at location 43 because chain 41 to which coil springs 41 are mounted is endless and is mounted on sprockets (not shown) with the one at location 43 being driven by motor 44 so that at location 43, coil springs 41 are caused to open due to being bent thereby releasing the coils of coil springs 41 from wires 1 whereby the cable is easily removed from the transfer mechanism 40.

The cable-making apparatus CMA makes cables continuously at high speed, they are easily removed from the transfer mechanism without the taped wire ends becoming untaped and operators are not subjected to any injuries resulting in safe operation.

Figure 3:
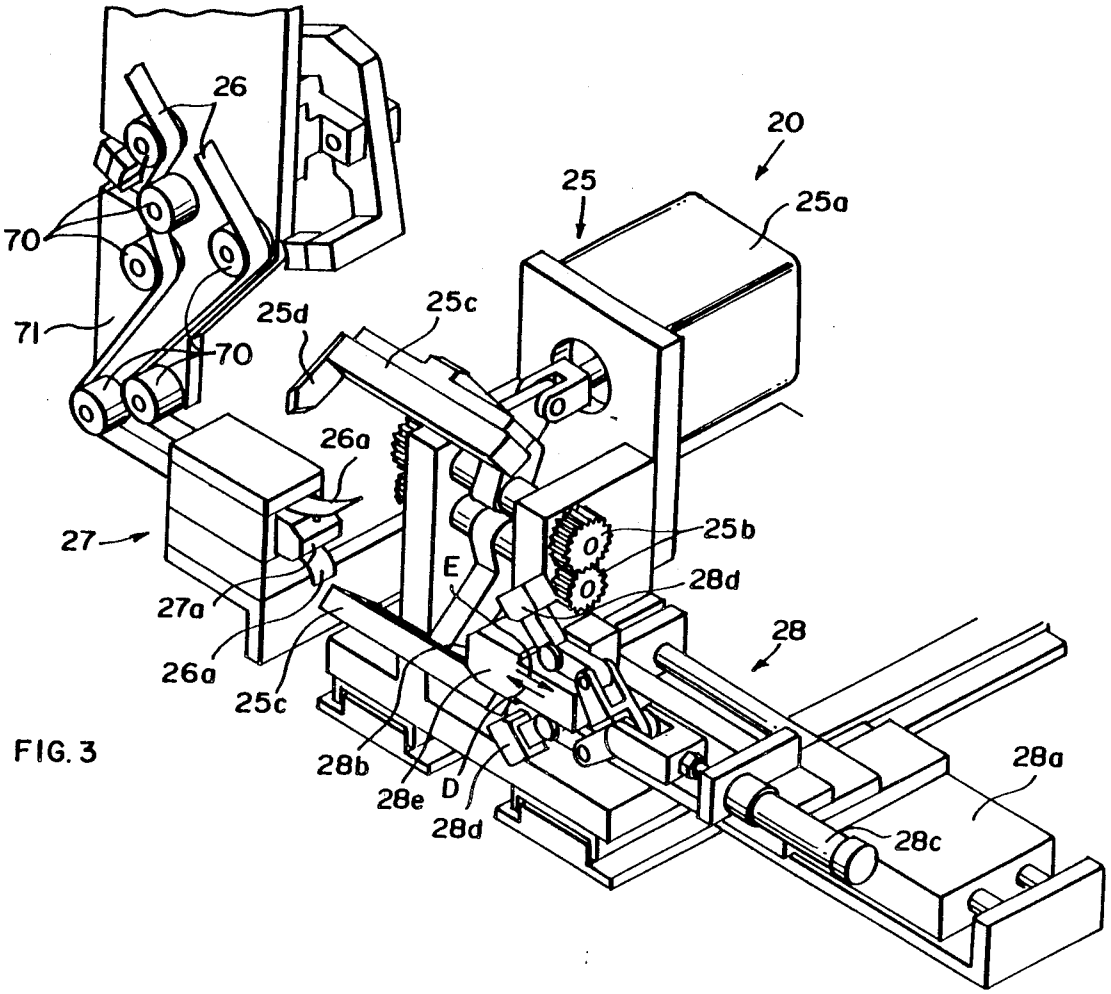
FIG. 3 is a perspective view of the tape-positioning and clamping mechanism.

Turning now to FIG. 3, tape-positioning and clamping mechanism 20 is described in greater detail. Two strips of tape 26 are unwound from supply rolls (not shown) and they move along rollers 70, which are mounted on plate 71, to tape-holding device 27 with leading ends 26*a* of the tapes 26 extending outwardly therefrom.

Block 28*e* of tape-positioning device 28 is moved in the direction of arrow D by the operation of cylinder 28*c* until the front end 28*b* engages the front end 27*a* of tape holding device 27. This causes tape clamping-arms 28*d*, which are pivotally mounted on block 28*e*, to clamp tape ends 26*a* between arms 28*d* and block 28*e*. Cylinder 28*c* is operated in the other direction thereby moving block 28*e* in the direction of arrow E along with tapes 26 clamped thereto by arms 28*d* so as to position tapes 26 parallel to each other as shown in FIG. 4A between tape-holding device 27 and tape-positioning device 28 and back of wire-spacing member 21 so that the ends of wires 1 can be positioned therebetween. The inside surfaces of tapes 26 have adhesive on them.

Figure 4B:
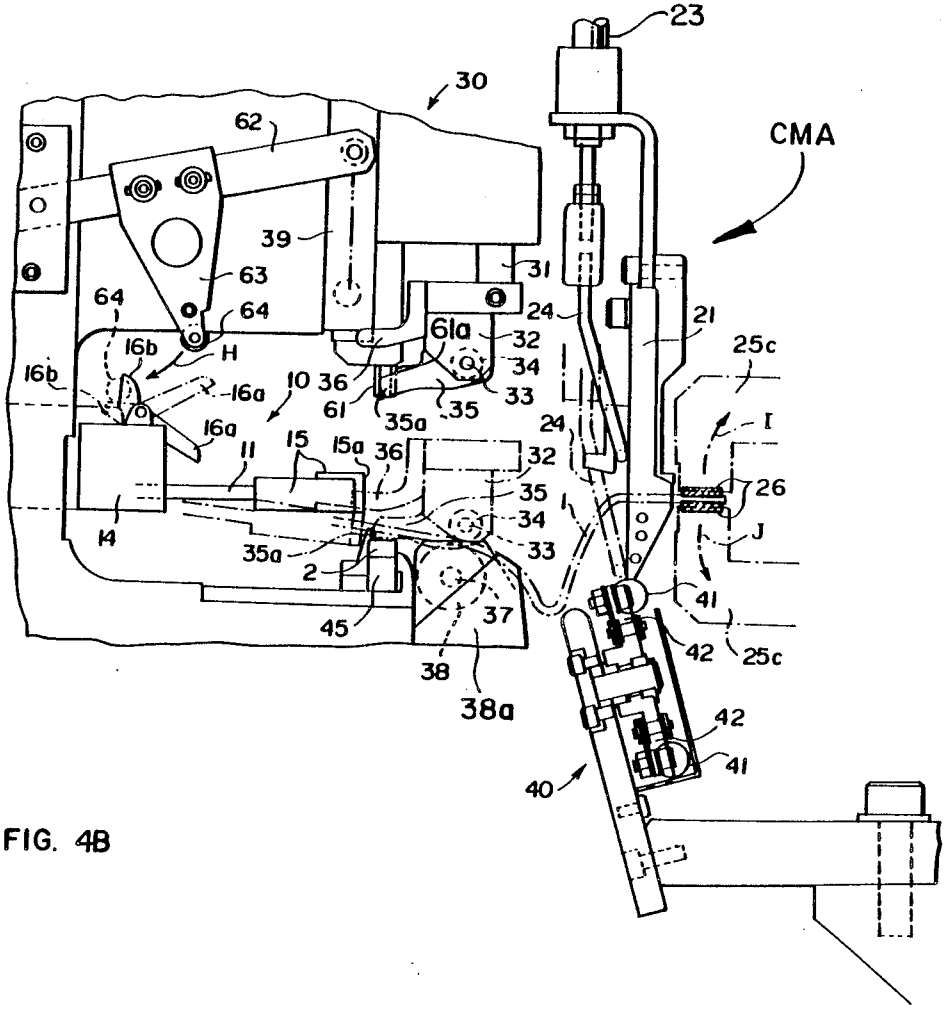

When the front ends of wires 1 are positioned between tapes 26, as described above, cylinder 25*a* of clamping mechanism 25 is operated which causes clamping members 25*c*, that are operatively coupled together via meshed gears 25*b*, to move toward one another thereby engaging tapes 26 and moving them into engagement with wire ends 1, as shown in FIG. 4B, and clamping the taped wire ends therebetween. Cutter blade 25*d* on one of clamping members 25*c* cuts tapes 26 between the clamping members 25*c* and holding device 27. With the taped wire ends clamped between clamping members 25*c*, long arm 16*a* of wire-clamping device 14 is moved downwardly, as shown in broken lines in FIG. 4A, by a clamp-releasing device (not shown) resulting in the wires being unclamped and shuttle mechanism 10 moves in the direction of arrow B, FIG. 2 along wires 1, returning to its original position, as described above.

Ram 31 is moved downwardly by a cylinder (not shown) and lever 36 projecting outwardly from roller holder 32 engages header device 15 moving it and tubes 11 with wires 1 therein downwardly so that the wires extend between wire guide members 35 that are pivotally mounted on shaft 33 of holder 32. Rollers 34 are also freely mounted on shaft 33 and they along with guide members 35 correspond to the same number and spacing of wires 1, rollers 34 having a concave outer surface in which the wires are disposed. Springs (not shown) extend between guide members 35 and holder 32 which maintain the guide members 35 in a lowered position, as shown in solid lines of FIG. 4B, but they move to a substantially horizontal position when ends 35*a* engage connector 2 on holder 45 when holder 32 is moved to a lower position by ram 31, as shown by the broken lines of FIG. 4B.

When ram 31 is lowered, holder 38*a* on which wire-feeding rollers 38 on shaft 37 are mounted is raised and wires 1 are engaged between rollers 34 and concave surfaces of respective rollers 38. A motor (not shown) drives shaft 37 and rollers 38 cause wires 1 to be fed to a prescribed length with guide members 35 guiding the wires.

After wires 1 have been fed to their prescribed length by rollers 34, 38, shaft 37 is stopped and the wires are clamped between rollers 34, 38. Ram 39 is then lowered by a cylinder (not shown and cutter members 61 on ram 39 cut the wires 1 and members 61*a* on ram 39 terminate the cut ends of the wires to termination sections of the electrical contacts in connector 2 thereby terminating the wires to the connector. Guide members 35 serve to align the wires with the termination sections of the contacts. Also, when ram 39 is lowered, lever 62 having one end pivotally mounted to ram 39 is moved downwardly, and roller 64 on support 63 mounted to lever 62 moves in the direction of arrow H engaging the short arm **16*b* of wire-clamping device 14 moving the long arm 16*a* to the upper position, as shown in FIG. 4A, thereby clamping the wires within the wire-clamping device 14** for subsequent making of another electrical cable.

Rams 39, 31 are now raised which cause clamping members **25*c* to move in the directions of arrows I, J, FIG. 4B, unclamping the taped ends of wires 1. Cylinders 23 are operated and cause wire-pusher member 24 to be lowered, as shown in broken lines in FIG. 4B, which pushes wires 1 from slots 21*a* of wire-spacer member 21 into the coils of coil spring 41 which has been positioned thereunder with the coils being spread apart by the teeth of spacer member 21 which has also been lowered by a cylinder (not shown). After the wires are positioned within the coil spring 41, spacer and pusher members 21, 24 are raised causing coil spring 41 to clamp wires 1** in the coils thereof.

Connector holder 45 with terminated connector 2 thereon is moved along track 46 by a ram (not shown) as transfer mechanism 40 is operated so that the cable is moved in the direction of arrow C, FIG. 1, until the cable reaches inspection device 50 on track 46. At this position, inspection device 50 checks the terminations of connector 2 and transfer mechanism 40 and holder 45 then move the cable to the end of track 46, as indicated by the distance T, FIG. 1, whereafter holder 45 is returned in the direction of arrow K to its original position and transfer mechanism 40 carries the cable to position 43 at which the cable is removed from transfer mechanism 40 as described above.

Figure 5:
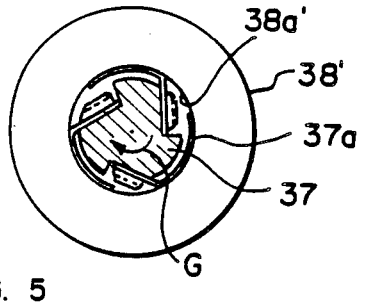
FIG. 5 is a cross-sectional view of a wire-feeding roller.
Figure 6A:
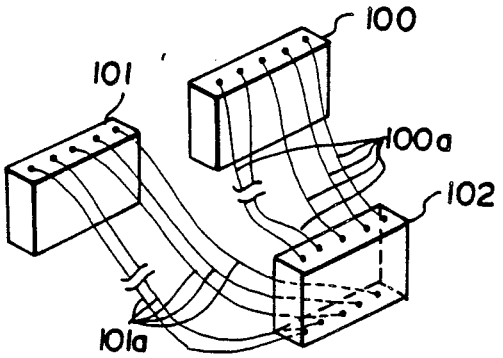
FIGS. 6A and 6B are schematic views showing respectively a final electrical cable and the electrical cable made by the present cable-making apparatus.
Figure 6B:
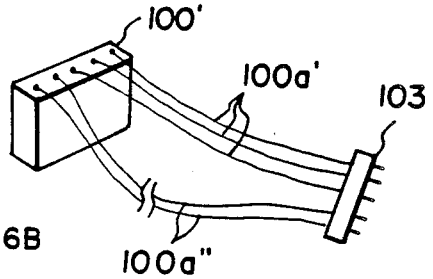

FIG. 5 shows a single roller 38 mounted on shaft 37. Three plate springs **37*a* secured on shaft 37 have arcuate sections frictionally engaging an inside surface 38*a* of roller 38. The arcuate sections of plate springs 37*a* frictionally engage surface 38*a* in a direction opposite to the direction of rotation of shaft 37 as indicated by arrow G. This enables rollers 38 to be driven by shaft 37**, and, if the load becomes too great, the rollers will remain stationary while the springs slip along the inside surfaces as the shaft rotates.

As described above, a cable-making apparatus is disclosed which includes a cable-making area wherein spaced ends of wires are positioned between spaced tapes that are applied to the wire ends and clamped, the wires are lengthened to a prescribed length and the wires are cut and terminated in an electrical connector thereby forming an electrical cable with one of the ends of the wires in taped spaced positions while the other ends are connected to an electrical connector, the cable being then transferred away from the cable-making area to a position at which the cable is easily removed, the taped wire ends remain taped together and the operator is not subjected to possible harm.

What is claimed is:

1. An electrical cable-making apparatus comprises a shuttle mechanism (10) that feeds electrical wires (1) from a first position to a second position to apply tapes (26) to ends of the wires, a wire-feeding mechanism (34, 38) to feed the wires to a prescribed length, cutting and terminating members **(61, 61*a*) for cutting the wires and for terminating them to an electrical connector (2), characterized in that a tape-positioning and clamping mechanism (20) comprises a tape-holding device (27) in which tapes (26) are held with ends (26*a*) of the tapes being engaged by a tape-positioning device (28) and being moved from the tape-holding device (27) to a position spaced from the tape-holding device so that the tapes (26) are parallel and in position to receive the wire ends therebetween when the shuttle mechanism (10) moves the wires (1) to the second position, a clamping mechanism (25) has clamping members (25*c*) that move the spaced tapes (26)** in engagement with the wire ends and clamp the taped wire ends therebetween.

2. An electrical cable-making apparatus as claimed in claim 1, characterized in that a cutter member **(25*d*) is on one of the clamping members (25*c*) to cut the tapes (26)** when they are clamped onto the wire ends.

3. An electrical cable-making apparatus as claimed in claim 1, characterized in that the shuttle mechanism (10) includes a header device (15), tubes (11) and a wire-clamping device (14) being movable relative to the header device (15) and tubes (11) to position the wire ends between the spaced tapes (26).

4. An electrical cable-making apparatus as claimed in claim 1, characterized in that the wire-feeding mechanism (34, 38) comprises freely rotatable rollers (34) and driven rollers (38) have arcuate surfaces between which the respective wires are disposed for feeding the wires to the prescribed length.

5. An electrical cable-making apparatus as claimed in claim 4, characterized in that wire guides (35) are located ajacent the rollers (34) for guiding the wires (1) while being fed by the rollers (34, 38) and for aligning the wires with terminating sections of electrical contacts in the connector (2).

6. An electrical cable-making apparatus as claimed in claim 3, characterized in that a wire-spacing member (21) has slots **(21*a*) through which the wires extend from the shuttle mechanism (10)**.

7. An electrical cable-making apparatus as claimed in claim 1, characterized in that a transfer mechanism (40) receives the taped wire ends after the cable has been made and moves the cable away from the cable-making area.

8. An electrical cable-making apparatus as claimed in claim 7, characterized in that the transfer mechanism (40) includes a chain (42) having spring coils (41) secured thereto at spaced intervals, the coil springs (41) receiving the wires therein.

* * * * *